US005142584A

United States Patent [19]

Ozawa

[11] Patent Number: 5,142,584

[45] Date of Patent: Aug. 25, 1992

[54] SPEECH CODING/DECODING METHOD HAVING AN EXCITATION SIGNAL

[75] Inventor: Kazunori Ozawa, Tokyo, Japan

[73] Assignee: NEC Corporation, Tokyo, Japan

[21] Appl. No.: 554,999

[22] Filed: Jul. 20, 1990

[30] Foreign Application Priority Data

Jul. 20, 1989 [JP] Japan ..... 1-189084

[51] Int. Cl.[5] ..... G10L 7/02

[52] U.S. Cl. ..... 381/36

[58] Field of Search ..... 381/36-40, 381/29-35, 41

[56] References Cited

U.S. PATENT DOCUMENTS

| | | | |
|---|---|---|---|
| 4,776,015 | 10/1988 | Takeda et al. | 381/41 |
| 4,847,905 | 7/1989 | Lefevre et al. | 381/36 |
| 4,864,621 | 9/1989 | Boyd | 381/38 |
| 4,896,361 | 1/1990 | Gerson | 381/40 |
| 4,932,061 | 6/1990 | Kroon et al. | 381/40 |
| 4,944,013 | 7/1990 | Gouvianakis et al. | 381/38 |
| 4,945,565 | 7/1990 | Ozawa et al. | 381/38 |

FOREIGN PATENT DOCUMENTS

| | | |
|---|---|---|
| 59-116794 | 7/1984 | Japan . |
| 2-58100 | 2/1990 | Japan . |
| 2-58100 | 2/1990 | Japan . |

OTHER PUBLICATIONS

M. R. Schroeder et al., "Code-Excited Linear Prediction (CELP): High-Quality Speech At Very Low Bit Rates", IEEE, 1985, pp. 937-940.

T. Araseki et al., "Multi-Pulse Excited Speech Coder Based On Maximum CrossCorrelation Search Algorithm", IEEE Global Telecommunications Conference, Globecom '83, Nov. 28-Dec. 1, 1983, pp. 794-798.

J. Makhoul et al., "Vector Quantization in Speech Coding", Proceedings of the IEEE. vol. 73, No. 11, Nov. 1985, pp. 1551-1588.

R. L. Zinser et al., "4800 and 7200 bit/sec Hyrid Codebook Multipulse Coding", IEEE, 1989, pp. 747-750.

S. Ono et al., "2.4 KBPS Pitch Prediction Multi-Pulse Speech Coding", Proceedings from ICASSP-International Conference on Acoustics, Speech, and Signal Processing, New York, N.Y., Apr. 11-14, 1988, pp. 175-178. (IEEE).

P. Kroon et al., "A Class of Analysis-by-Synthesis Predictive Coders for High Quality Speech Coding at Rates Between 4.8 and 16 kbits/s", IEEE Journal on Selected Areas in Communications, vol. 6, No. 2, Feb. 1988, pp. 353-363.

A. V. Oppenheim et al., "Digital Signal Processing", Prentice-Hall, Inc., 1975, pp. vii-viii-1-5.

*Primary Examiner*—Dale M. Shaw
*Assistant Examiner*—Michelle Doerrler
*Attorney, Agent, or Firm*—Sughrue, Mion, Zinn, Macpeak & Seas

[57] ABSTRACT

A speech coding method in which spectrum parameter representing a spectrum envelope and a pitch parameter representing a pitch are obtained from an input discrete speech signal. A frame interval is divided into subintervals in accordance with the pitch parameter. A sound source signal in one of the subintervals is obtained by obtaining a multipulse with respect to a difference signal obtained by performing prediction on the basis of a past sound source signal. Correction information for correcting at least one of the amplitude and the phase of the sound source signal are obtained and output in other pitch intervals in the frame.

2 Claims, 3 Drawing Sheets

SPEECH CODING/DECODING METHOD HAVING AN EXCITATION SIGNAL

BACKGROUND OF THE INVENTION

The present invention relates to a speech coding/decoding method for coding a speech signal with high quality at a low bit rate, specifically at 4.8 kb/s or less, by a relatively small amount of operations.

As methods of coding a speech signal at a low bit rate of about 4.8 kb/s or less, speech coding methods disclosed in, e.g., Japanese Patent Application No. 63-208201 disclosed as Japanese Patent Laid-Open No. HEI 02-58100 (reference 1) and M. Schroeder and B. Atal, "Code-excited linear prediction: High quality speech at very low bit rates," ICASSP, pp. 937–940, 1985 (reference 2) are known.

According to the method in reference 1, on the transmission side, a spectrum parameter representing the spectrum characteristics of a speech signal and a pitch parameter representing the pitch thereof are extracted from a speech signal of each frame. Speech signals are classified into a plurality of types of signals (e.g., vowel, explosive, and fricative sound signals) using acoustic features. A one-frame sound source signal in a vowel sound interval is represented by improved pitch interpolation in the following manner. A signal component in one pitch interval (representative interval) of a plurality of pitch intervals obtained by dividing one frame is represented by a multipulse. In other pitch intervals in the same frame, amplitude and phase correction coefficients for correcting the amplitude and phase of the multipulse in the representative interval are obtained in units of pitch intervals. Subsequently, the amplitude and position of the multipulse in the representative interval, the amplitude and phase correction coefficients in other pitch intervals, and the spectrum and pitch parameters are transmitted. In an explosive sound interval, a multipulse in the entire frame is obtained. In a fricative sound interval, one type of noise signal is selected from a codebook constituted by predetermined types of noise signals so as to minimize differential power between a signal obtained by synthesizing noise signals and the input speech signal, and an optimal gain is calculated. As a result, an index representing the type of noise signal and the gain are transmitted. A description associated with the reception side will be omitted.

In the conventional speech coding methods disclosed in reference 1, with respect to a female speaker having a short pitch period, since a large number of pitch intervals are present in a frame, improved pitch interplation can be effectively performed, and a sufficient number of pulses can be equivalently obtained for the entire frame. For example, if the frame length is 20 ms, the pitch period is 4 ms, and the number of pulses in a representative interval is 4, 20 pulses can be equivalently obtained for the entire frame.

With respect to a male speaker having a long pitch period, however, since a sufficient number of pulses cannot be equivalently obtained for the entire frame, improved pitch interpolation does not exhibit a satisfactory effect. Therefore, a problem is posed in terms of sound quality. For example, if the pitch period is 10 ms, and the number of pulses per pitch is 4, the number of pulses in the entire frame is 8, which is very small as compared with the case of a female speaker. In order to increase the number of pulses in the entire frame, the number of pulses per pitch must be increased. However, if this number is increased, the bit rate is increased. For this reason, it is difficult to increase the number of pulses.

In addition, if the bit rate is decreased from 4.8 kb/s to 3 kb/s or 2.4 kb/s, the number of pulses per pitch must be decreased to 2 or to 3. Therefore, a problem worse than the above-described problem will be posed. At such a low bit rate, the effect of improved pitch interpolation becomes insufficient even for a female speaker.

In the code-excited linear prediction (CELP) method disclosed in reference 2, if the bit rate is decreased below 4.8 kb/s, the number of bits of a codebook must be decreased, resulting in abrupt degradation of sound quality. For example, at 4.8 kb/s, a 10-bit codebook is generally used for a subframe of 5 ms. However, at 2.4 kb/s, the number of bits of the codebook must be decreased to 5, provided that the period of the subframe is kept to be 5 ms. Since 5 bits are too small as the number of bits to cover various types of sound source signals, the sound quality is abruptly degraded at a bit rate lower than about 4.8 kb/s.

SUMMARY OF THE INVENTION

It is an object of the present invention to provide a speech coding/decoding method for performing high-quality speech coding/decoding at 4.8 kb/s or less by a relatively small amount of operations.

A speech coding method according to the present invention comprises the steps of obtaining a spectrum parameter representing a spectrum envelope and a pitch parameter representing a pitch from an input discrete speech signal, dividing a frame interval into subintervals in accordance with the pitch parameter, obtaining a sound source signal in one of the subintervals by obtaining a multipulse with respect to a difference signal obtained by performing prediction on the basis of a past sound source signal, and obtaining and outputting correction information for correcting at least one of an amplitude and a phase of the sound source signal in other pitch intervals in the frame.

A sequence of operations based on the speech coding/decoding method of the present invention will be described below.

In a voiced interval having periodic properties for each pitch, a pitch parameter representing a pitch period is obtained in advance from a speech signal in the frame. For example, the frame interval of a speech waveform shown in FIG. 3(*a*) is divided into a plurality of pitch intervals (subframes) in units of pitch periods as shown in FIG. 3(*b*). A multipulse having a predetermined number of pulses is obtained with respect to a difference signal obtained by performing prediction in one pitch interval (representative interval) of the pitch intervals by using a past sound source signal. Subsequently, gain and phase correction coefficients for correcting the gain and phase of the multipulse in the representative interval are obtained for other subframes in the same frame.

A method of performing pitch prediction will be described below. Assume that a drive sound source signal reproduced in the previous frame is represented by v(n), and a prediction coefficient and a period are respectively represented by b and M. In addition, assume that an interval ① in FIG. 3(*c*) is a representative interval of a current frame, and a speech signal in this interval is represented by $x_1(n)$. The coefficient b and the period M are calculated to minimize the differential power of the following equation:

$$E=\Sigma_n[\{x_1(n)-b\cdot v(n-M)*h(n)\}*w(n)]^2 \quad (1)$$

where w(n) is the impulse response of a perceptual weighting filter, (for a detailed description thereof, refer to Japanese Patent Application No. 57-231605 disclosed as Japanese Patent Laid-Open No. 59-116794 (reference 3) and the like), h(n) is the impulse response of a synthesizing filter constituted by a spectrum parameter obtained from the speech of the current frame by known linear prediction (LPC) analysis (for a detailed description thereof, refer to reference 3 and the like), and * is the convolution sum.

In order to minimize equation (1), equation (1) is partially differentiated by b to be 0 so as to obtain the following equation:

$$b = \sum_n x_{1w}(n)\bar{x}_w(n) / \sum_n \bar{x}_w(n)\bar{x}_w(n) \quad (2)$$

$$\text{where } \bar{x}_w(n) = b\cdot v(n-M)*h(n)*w(n) \quad (3)$$

A substitution of equation (2) into equation (1) yields:

$$E = \sum_n x_{1w}(n)^2 - \left\{\sum_n x_{1w}(n)\bar{x}_w(n)\right\}^2 / \sum_n \bar{x}_w(n)\bar{x}_w(n) \quad (4)$$

Since the first term of equation (4) is a constant term, equation (1) can be minimized by maximizing the second term of equation (4). The second term of equation (4) is calculated for various values of M, and the value of M which maximizes the second term is obtained. The value of b is then calculated from equation (2).

Pitch prediction is performed with respect to the interval (1) by using the obtained values b and M according to the following equation so as to obtain a difference signal e(n):

$$e(n)=x_1(n)-b\cdot v(n-M)*h(n) \quad (5)$$

FIG. 3(*c*) shows an example of e(n).

Subsequently, a multipulse having a predetermined number of pulses is obtained with respect to the difference signal e(n). As a practical method of obtaining a multipulse, a method of using a cross-correlation function $\Phi_{xh}$ and an auto-correlation function $R_{hh}$ is known. Since this method is disclosed in, e.g., reference 3 and Araseki, Ozawa, Ono, and Ochiai, "Multi-pulse Excited Speech Coder Based on Maximum Cross-correlation Search A logarithm", GLOBECOM 83, IEEE Global Tele-communications Conference, lecture number Mar. 23, 1983 (reference 4), a description of this method will be omitted. FIG. 3(*d*) shows the multipulse obtained in the interval (1) as an example, in which two pulses are obtained.

As a result, a sound source signal d(n) in the interval (1) is obtained according to the following equation:

$$d(n) = b\cdot v(n-M) + \sum_i g_i\cdot\delta(n-m_i) \quad (6)$$

-continued $$\text{for } \delta(n-m_i)\begin{cases} 1\ (n=m_i) \\ = \\ 0\ (n\neq m_i)\end{cases}$$

where $g_i$ and $m_i$ are the amplitude and position of an ith pulse of the multipulse.

In pitch intervals other than the representative interval, gain and phase correction coefficients for correcting the gain and the phase of the sound source signal in the representative interval are calculated in units of intervals. If a gain correction coefficient and a phase correction coefficient in a jth pitch interval are respectively represented by $c_j$ and $d_j$, these values can be calculated to minimize the following equation:

$$E = \sum_n [\{x_j(n) - c_j\cdot d(n-T-d_j)*h(n)\}*w(n)]^2 \quad (7)$$

Since the solution of the above equation is described in detail in reference 3 and the like, a description thereof will be omitted. A sound source signal of the frame is obtained by obtaining gain and phase correction coefficients in the respective pitch intervals other than the representative pitch interval according to equation (7).

FIG. 3(*e*) shows the drive sound source signal of the current frame, as an example, reproduced by obtaining the gain and phase correction coefficients in the pitch intervals other than the interval (1).

In this case, a representative interval is fixed to the pitch interval (1). However, a pitch interval in which differential power between input speech of a frame and synthesized speech is minimized may be selected as a representative interval by checking several pitch intervals in the frame. With respect to a detailed description of this method, refer to reference 1 and the like.

Information to be transmitted as sound source information for each frame includes the position of a representative pitch interval in a frame (not required when a representative interval is fixed); the prediction coefficient b, the period M, the amplitude and position of a multipulse in the representative interval; and gain and phase correction coefficients in other pitch intervals in the same frame.

According to the second aspect of the present invention, instead of obtaining a multipulse with respect to a difference signal e(n) obtained by performing prediction in a representative interval, vector quantization is performed by using a codebook. This method will be described in detail below. Assume that $2^B$ (B is the number of bits of a sound source) types of sound source signal vectors (code vectors) are stored in the codebook. If one sound source signal vector in the codebook is represented by c(n), the sound source signal vector is selected from the codebook so as to minimize the following equation:

$$E=\Sigma_n[\{e(n)-g\cdot c(n)*h(n)\}*w(n)]^2 \quad (8)$$

where g is the gain of the sound source signal. In order to minimize equation (8), equation (8) is partially differentiated by g to be 0 so as to obtain the following equation:

$$g=\Sigma_n e_w(n)\bar{e}w(n)/\Sigma\bar{e}w(n)\bar{e}w(n) \quad (9)$$

where $$e_w(n)=e(n)*h(n) \quad (10)$$

$$\bar{e}_w(n)=c(n)*h(n)*w(n) \quad (11)$$

A substitution of equation (9) into equation (8) yields:

$$E=\Sigma_n e_w(n)^2-\{\Sigma_n e_w(n)\bar{e}_w(n)\}^2\Sigma_n\bar{e}_w(n)\bar{e}_w(n) \quad (12)$$

Since the first term of equation (12) is a constant term, the second term is calculated for all the values of the sound source vector c(n), and a value which maximizes the second term is selected. In this case, the gain is obtained according to equation (9).

The codebook may be formed by learning based on training signals, or may be constituted by, e.g., Gaussian random signals. The former method is described in, e.g., Makhoul et al., "Vector Quantization in Speech Coding," Proc. IEEE, vol. 73, 11, 1551-1588, 1985 (reference 5). The latter method is described in reference 2.

DETAILED DESCRIPTION OF THE PREFERRED EMBODIMENTS

Figure 1:
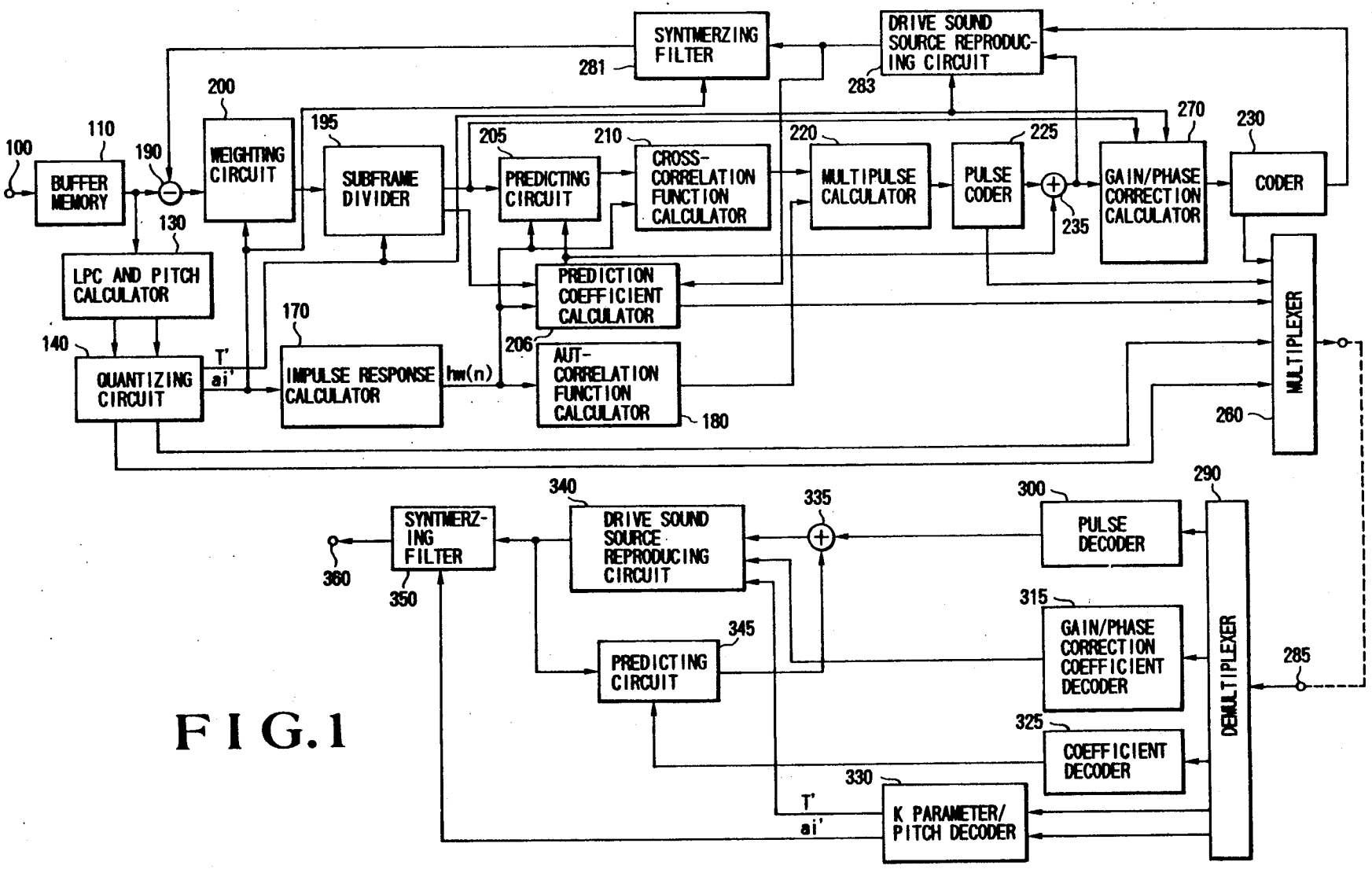
FIG. 1 is a block diagram showing a system based on a speech coding/decoding method according to the first embodiment of the present invention.

FIG. 1 shows a system for implementing a speech coding/decoding method according to the first embodiment of the present invention.

Referring to FIG. 1, a transmission side receives a speech signal through an input terminal 100, and stores a one-frame (e.g., 20 ms) speech signal in a buffer memory 110.

An LPC and pitch calculator 130 performs known LPC analysis of the one-frame speech signal to calculate a K parameter corresponding to a predetermined degree P, as a parameter representing the spectrum characteristics of the one-frame speech signal. With regard to a detailed description of this method of calculating the K parameter, refer to K parameter calculators in the above-described references 1 and 3. Note that a K parameter is identical to a PARCOR coefficient. A quantizing circuit 140 outputs a code $l_K$ obtained by quantizing the K parameter with a predetermined number of quantization bits to a multiplexer 260 and decoded into a linear prediction coefficient $a_i'$ (i=1 to P). The coefficient $a_i'$ is then output to a weighting circuit 200, an impulse response calculator 170, and a synthesizing filter 281. With regard to methods of coding the K parameter and converting the K parameter into the linear prediction coefficient, refer to the above-described references 1 and 3. An average pitch period T is calculated from the one-frame speech signal. As this method, a method based on auto-correlation is known. With regard to a detailed description of this method, refer to a pitch extracting circuit in reference 1. In addition, other known methods (e.g., the cepstrum method, the SIFT method, and the partial correlation method) may be used. A code obtained by quantizing the average pitch period T with a predetermined number of bits is output to the multiplexer 260. In addition, a decoded pitch period T' obtained by decoding this code is output from the quantizing circuit 140 to a subframe divider 195, a drive sound source reproducing circuit 283, and a gain/phase correction calculator 270.

The impulse response calculator 170 calculates an impulse response $h_W(n)$ of the synthesizing filter, which performs perceptual weighting, by using the linear prediction coefficient $a_i'$, and outputs it to an auto-correlation calculator 180 and a cross-correlation calculator 210.

The auto-correlation calculator 180 calculates and outputs an auto-correlation function $R_{hh}(n)$ of the impulse response $h_w(n)$ with a predetermined time delay. With regard to the operations of the impulse response calculator 170 and the auto-correlation calculator 180, refer to references 1 and 3 and the like.

A subtracter 190 subtracts a one-frame component of an output from the synthesizing filter 281 from a one-frame speech signal x(n), and outputs the subtraction result to the weighting circuit 200.

The weighting circuit 200 obtains a weighted signal $x_w(n)$ by filtering the subtraction result through a perceptual weighting filter whose impulse response is represented by w(n), and outputs it. With regard to the weighting method, refer to references 1 and 3 and the like.

The subframe divider 195 divides the weighed signal of the frame at pitch intervals of T'.

A prediction coefficient calculator 206 obtains a prediction coefficient b and a period M by using a previously reproduced drive sound source signal v(n), the impulse response $h_w(n)$, and one of the weighted signals divided at the pitch intervals of T' in a predetermined representative interval (e.g., an interval ① in FIG. 3(*c*)), according to equations (1) to (4). The obtained values are then quantized with a predetermined number of bits to obtain values b' and M'. The prediction coefficient calculator 206 further calculates a prediction sound source signal v'(n) according to the following equation, and outputs it to a predicting circuit 205:

$$v'(n)=b'\cdot v(n-M') \quad (13)$$

The predicting circuit 205 performs prediction by using the signal v'(n) according to the following equation to obtain a difference signal in the representative interval (the interval ① in FIG. 3(*c*):

$$e_w(n)=x_w(n)-v'(n)*h_w(n) \quad (14)$$

The cross-correlation function calculator 210 receives the values $e_w(n)$ and $h_w(n)$, calculates a cross-correlation function $\Phi x_{xh}$ with a delay time, and outputs the calculation result. With regard to this calculation method, refer to references 1 and 3 and the like.

A multipulse calculator 220 obtains a position $m_i$ and an amplitude $g_i$ of a multipulse with respect to the difference signal in the representative interval, which is obtained by equation (14), by using the cross-correlation function and the auto-correlation function.

A pulse coder 225 codes the amplitude $g_i$ and the position $m_i$ of the multipulse in the representative interval with a predetermined number of bits, and outputs them to the multiplexer 260. At the same time, the pulse coder 225 decodes the coded multipulse and outputs it to an adder 235.

The adder 235 adds the decoded multipulse to the prediction sound source signal v'(n) output from the prediction coefficient calculator 206 so as to obtain a sound source signal d(n) in the representative interval.

The gain/phase correction calculator 270, as described in the summary, calculates and outputs a gain correction coefficient $c_k$ and a phase correction coefficient $d_k$ of the sound source d(n) in the representative interval in order to reproduce a sound source signal in another pitch interval k in the same frame. With regard to a detailed description of this method, refer to reference 1.

A coder 230 codes the gain correction coefficient $c_k$ and the phase correction coefficient $d_k$ with a predetermined number of bits, and outputs them to the multiplexer 260. In addition, the coder 230 decodes them and outputs the decoded values to the drive sound source reproducing circuit 283.

The drive sound source reproducing circuit 283 divides the frame by the average pitch period T' in the same manner as in the subframe divider 195, and generates the sound source signal d(n) in a representative interval. The circuit 283 reproduces a drive sound source signal v(n) of the entire frame in pitch intervals other than the representative interval by using the sound source signal d(n) and the decoded gain and phase correction coefficients in the representative interval in accordance with the following equation:

$$v(n)=\Sigma_k c_k \cdot d(n-T'-d_k)+d(n) \quad (15)$$

The synthesizing filter 281 receives the reproduced drive sound source signal v(n) and the linear prediction coefficient $a_i'$ and obtains a one-frame composite speech signal. In addition, the filter 281 calculates a one-frame influence signal which influences the next frame, and outputs it to the subtracter 190. With regard to the method of calculating the influence signal, refer to reference 3.

The multiplexer 260 multiplexes and outputs the codes representing the prediction coefficient, the period, the amplitude and position of the multipulse in the representative interval, the codes representing the gain and phase correction coefficients and the average pitch period, and the code representing the K parameter.

The above description is associated with the transmission side according to the first embodiment of the present invention.

On the decoding side, a demultiplexer 290 receives the multiplexed codes through a terminal 285, and separates and outputs the code representing the multipulse, the codes representing the gain and phase correction coefficients, the codes representing the prediction coefficient and the period, the code representing the average pitch period, and the code representing the K parameter.

A K parameter/pitch decoder 330 decodes the codes representing the K parameter and the pitch period, and outputs the decoded pitch period T' to a drive sound source reproducing circuit 340.

A pulse decoder 300 decodes the code representing the multipulse, generates a multipulse in a representative interval, and outputs it to an adder 335.

The adder 335 adds the multipulse from the pulse decode 300 to a prediction sound source signal v'(n) from a predicting circuit 345 so as to obtain a sound source signal d(n).

A gain/phase correction coefficient decoder 315 receives the codes representing the gain and phase correction coefficients, decodes them, and outputs the obtained values.

A coefficient decoder 325 decodes the cods representing the prediction coefficient and the period to obtain a coefficient b' and a period M', and outputs them.

The predicting circuit 345 calculates a prediction sound source signal v'(n) from the drive sound source signal v(n) of the previous frame by using the values b' and M' in accordance with equation (13), and outputs it to the adder 335.

The drive source source reproducing circuit 340 receives the output from the adder 335, the decoded pitch period T', the decoded gain correction coefficient, and the decoded phase correction coefficient. Subsequently, with the same operation as performed by the drive sound source reproducing circuit 283 on the transmission side, the circuit 340 reproduces the one-frame drive sound source signal v(n) and outputs it.

A synthesizing filter 350 receives the reproduced one-frame drive sound source signal nd the linear predication coefficient $a_1'$, calculates one-frame synthesized speech x(n), and outputs it through a terminal 360.

The above description is associated with the reception side according to the first embodiment of the present invention.

Figure 2:
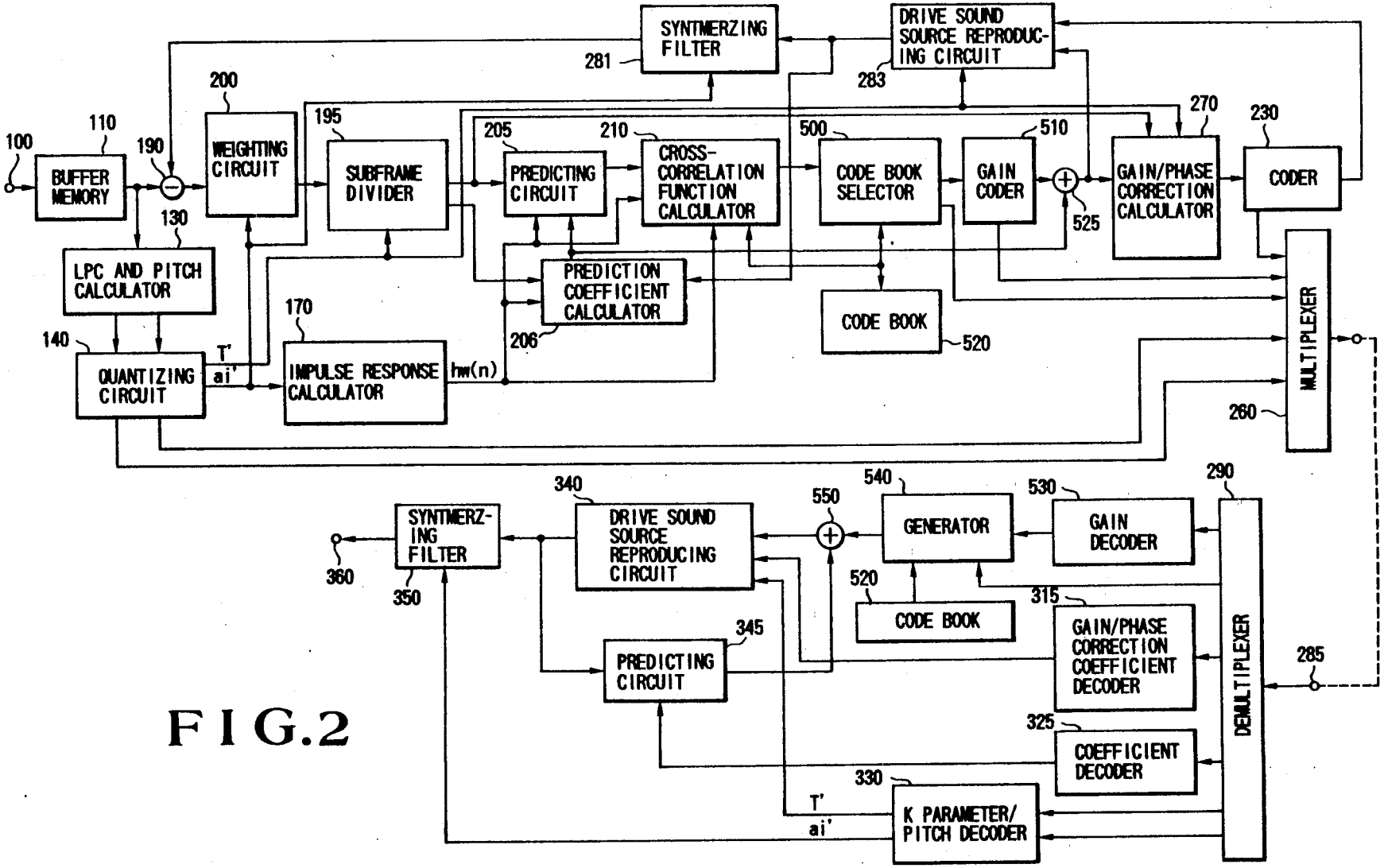
FIG. 2 is a block diagram showing a system based on a speech coding/decoding method according to the second embodiment of the present invention.
Figure 3A:
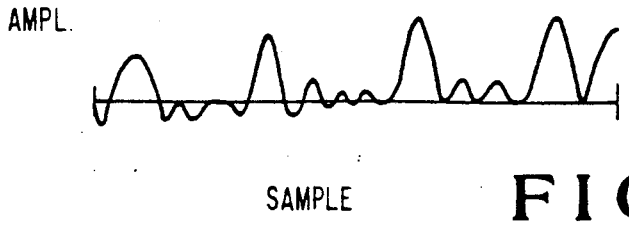
FIGS. 3(*a*) to 3(*e*) are graphs for explaining a sequence of operations based on the method of the present invention.
Figure 3B:
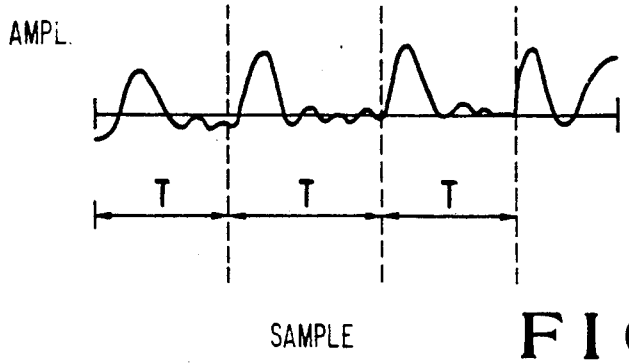
Figure 3C:
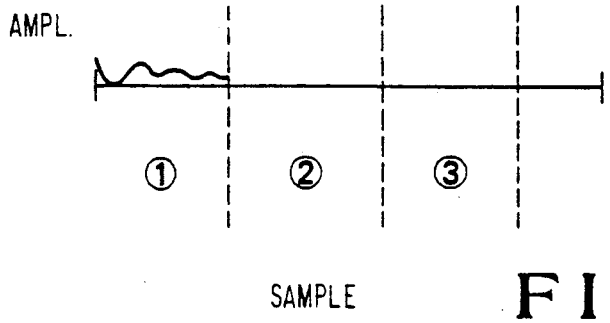
Figure 3D:
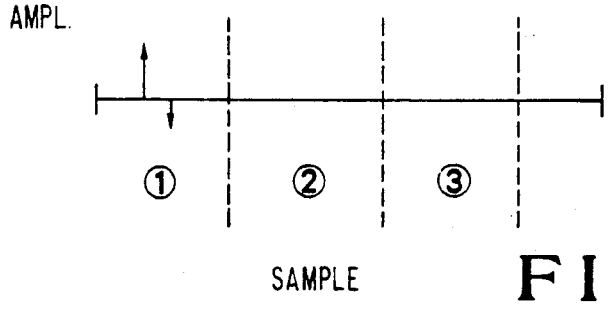
Figure 3E:
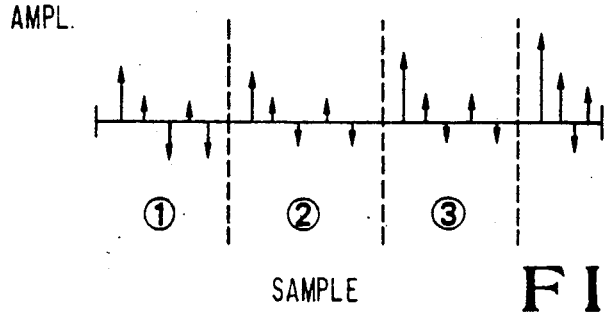

FIG. 2 shows the second embodiment of the present invention. The same reference numerals in FIG. 2 denote the same parts as in FIG. 1, and a description thereof will be omitted.

In this embodiment, an optimal code vector is selected from a codebook 520 with respect to a prediction difference signal calculated according to equations (1) to (4) and (14), and a gain g of the code vector is calculated. In this case, a code vector c(n) is selected and the gain g is obtained with respect to a value $e_w(n)$ obtained by equation (14) so as to minimize equation (8). Assume that the number of dimensions of a code vector of the codebook is given by L and the type of code vector is $2^B$. In addition, assume that the codebook is constituted by Gaussian random signals as in reference 2.

A cross-correlation calculator 505 calculates a cross-correlation function Φ and an auto-correlation function R in accordance with the following equations:

$$\Phi=\Sigma_n \bar{e}_w(n) ew(n) \quad (16)$$

$$R=\Sigma_n \bar{e}_w(n) \bar{e}_w(n) \quad (17)$$

where $e_w(n)$ and $e_w(n)$ are obtained according to equations (10) and (11). In addition, equations (16) and (17) respectively correspond to the numerator and denominator of equation (9). Calculations based on equations (16) and (17) are performed for all the code vectors, and values of Φ and R corresponding to each code vector are output to a codebook selector 500.

The codebook selector 500 selects a code vector which maximizes the second term of equation (12). The second term of equation (12) can be rewritten as follows:

$$D=\Phi^2/R \quad (18)$$

Therefore, a code vector which maximizes equation (18) is selected. The gain g of the selected code vector can be calculated by the following equation:

$$g=\Phi/R \quad (19)$$

The codebook selector 500 outputs data representing the index of the selected codebook to a multiplexer 260, and outputs the obtained gain g to a gain coder 510.

The gain coder 510 quantizes the gain with a predetermined number of bits, and outputs the code to the multiplexer 260. At the same time, the coder 510 obtains a sound source signal z(n) based on the selected codebook by using a decoded value g' according to the following equation, and outputs it to an adder 525:

$$z(n)=g'\cdot c(n) \tag{20}$$

The adder 525 adds a prediction sound source signal v'(n) obtained by equation (13) to the value z(n) according to the following equation in order to obtain a sound source signal d(n) in the representative interval, and outputs it to a drive sound source decoder 283 and a gain/phase correction calculator 270:

$$d(n)=v'(n)+z(n) \tag{21}$$

The above description is associated with the transmission side according to the second embodiment of the present invention.

The reception side of the system according to the second embodiment will be described below. A gain decoder 530 decodes the code representing the gain and outputs a decoded gain g'. A generator 540 receives the code representing the index of the selected codebook, and selects a code vector c(n) from a codebook 520 in accordance with the index. The generator 540 then generates a sound source signal z(n) by using the decoded gain g' according to equation (20), and outputs it to an adder 550.

The adder 550 performs the same operation as performed by the adder on the transmission side so as to obtain a sound source signal d(n) in the representative interval by adding the value z(n) to a prediction sound source signal v'(n) output from a predicting circuit 345, and outputs it to a drive sound source reproducing circuit 340.

The above description is associated with the reception side according to the second embodiment of the present invention.

The above-described embodiments are only examples of the present invention, and various modifications can be made.

In the first embodiment, the amplitude and position of the multipulse obtained with respect to the prediction difference signal in the representative interval are scalar-quantized (SQed). However, in order to reduce the amount of information, these values may be vector-quantized (VQed). For example, only the position may be VQed while the amplitude is SQed, or the amplitude may be VQed while the position is SQed. Alternatively, both the amplitude and position may be VQed. With regard to a detailed description of the method of VQing the position, refer to, e.g., R. Zinser et al., "4800 and 7200 bit/sec Hybrid Codebook Multipulse Coding," (ICASSP, pp. 747–750, 1989) (reference 6).

Furthermore, in the first embodiment, the gain correction coefficient $c_k$ and the phase correction coefficient $d_k$ are obtained and transmitted in pitch intervals other than the representative interval. However, the decoded average pitch period T' may be interpolated by using the adjacent pitch period for each pitch interval so that transmission of a phase correction coefficient can be omitted. In addition, instead of transmitting a gain correction coefficient in each pitch interval, a gain correction coefficient obtained in each pitch interval may be approximated by a least square curve or a least square line, and transmission may be performed by coding the coefficient of the curve or line. These methods may be used in an arbitrary combination. With these arrangements, the amount of information for transmission of correction information can be reduced.

Instead of obtaining a phase correction coefficient in each pitch interval, a linear phase term $\tau$ may be obtained from an end portion of a frame so as to be assigned to each pitch interval, as disclosed in, e.g., Ono and OZawa et al., "2.4 kbps Pitch Prediction Multipulse Speech Coding", Proc. ICASSP S4.9, 1988) (reference 7). According to another method, a phase correction coefficient obtained in each pitch interval is approximated by a least square line or a least square curve, and transmission is performed by coding the coefficient of the line or curve.

Moreover, in the first embodiment of the present invention, different sound source signals may be used in accordance with the feature of a one-frame speech signal, as in reference 1. For example, speech signals are classified into, e.g., vowel, nasal, fricative, and explosive sound signals, and the arrangement of the first embodiment may be used in a vowel sound interval.

In the first and second embodiments, a K parameter is coded as a spectrum parameter, and LPC analysis is employed as an analysis method thereof. However, as a spectrum parameter, other known parameters such as an LSP, an LPC cepstrum, a cepstrum, an improved cepstrum, a generalized cepstrum, and a melcepstrum may be used. An optimal analysis method may be used for each parameter.

Furthermore, in the first and second embodiments, when prediction is to be performed, a representative interval is fixed to a predetermined pitch interval in a frame. However, prediction may be performed in each pitch interval in a frame to calculate a sound source signal with respect to a predicted difference signal, and gain and phase correction coefficients in other pitch intervals are calculated. Furthermore, a weighted differential power between a speech signal of the frame reproduced by the above operation and an input signal is calculated, and a pitch interval which minimizes the differential power is selected as a representative interval. With regard to a detailed description of this method, refer to reference 1. With this arrangement, although the operation amount is increased, and information representing the position of the representative interval in the frame must be additionally transmitted, the characteristics of the system are further improved.

In the subframe divider 195, a frame is divided into pitch intervals each having a length equal to that of a pitch period. However, a frame may be divided into pitch intervals each having a predetermined length (e.g., 5 ms). With this arrangement, although no pitch period need be extracted, and the operation amount is reduced, the sound quality is slightly degraded.

Furthermore, in order to reduce the operation amount, calculation of an influence signal may be omitted on the transmission side. With this omission, the drive signal reproducing circuit 283, the synthesizing filter 281, and the subtracter 190 on the transmission side can be omitted, but the sound quality is degraded.

In order to improve the sound quality by shaping quantization noise, an adaptive post filter which is operated in response to at least a pitch or a spectrum envelope may be connected to the output terminal of the synthesizing filter 350 on the decoding side. With regard to the arrangement of the adaptive post filter, refer to, e.g., Kroon et al., "A Class of Analysis-by-synthesis Predictive Coders for High Quality Speech Coding at Rates between 4.8 and 16 kb/s," (IEEE JSAC, vol. 6,2, 353-363, 1988) (reference 8).

As is well known in the field of digital signal processing, auto-correlation and cross-correlation functions respectively correspond to a power spectrum and a cross-power spectrum on a frequency axis, and hence can be calculated on the basis of these spectra. With regard to the method of calculating these functions, refer to Oppenheim et al., "Digital Signal Processing" (Prentice-Hall, 1975) (reference 9).

As has been described above, according to the present invention, a sound source signal in a representative interval can be very effectively represented by dividing a frame in units of pitch periods, prediction for one pitch interval (representative interval) is performed on the basis of a past sound source signal, and by properly representing a prediction error by a multipulse or a sound source signal vector (code vector). In addition, in other pitch intervals of the same frame, the gain and phase of the sound source signal in the representative interval are corrected to obtain the sound source signal of the frame so that the sound source signal of the speech of the frame can be properly represented by a very small amount of sound source information. Therefore, according to the present invention, decoded/reproduced speech having excellent sound quality can be obtained as compared with the conventional method.

What is claimed is:

1. A speech coding method comprising the steps of:

obtaining a linear prediction spectrum parameter representing a spectrum envelope for a short-time input discrete speech signal and a pitch parameter representing a pitch period from an input discrete speech signal;

dividing a frame interval into subintervals in accordance with the pitch parameter;

obtaining a sound source signal in one of the subintervals by obtaining a multipulse with respect to a difference signal obtained by performing prediction on the basis of a past sound source signal;

obtaining correction information for correcting at least one of an amplitude and a phase of the sound source signal in other pitch intervals in the frame; and outputting the correction information, said linear prediction spectrum parameter and said pitch parameter.

2. A speech coding method comprising the steps of:

obtaining a linear prediction spectrum parameter representing a spectrum envelope for a short-time input discrete speech signal and a pitch parameter representing a pitch period from an input discrete speech signal;

dividing a frame interval into subintervals in accordance with the pitch parameter;

obtaining a sound source signal in one of the subintervals by selecting one type of sound source signal, with respect to a difference signal obtained by performing prediction on the basis of a past sound source signal, from a codebook in which sound source signal vectors are stored;

obtaining correction information for correcting at least one of an amplitude and a phase of the sound source signal in other pitch intervals in the frame; and outputting the correction information, the linear prediction spectrum parameter and the pitch parameter.

* * * * *